US006986343B2

(12) United States Patent
Carnall et al.

(10) Patent No.: US 6,986,343 B2
(45) Date of Patent: Jan. 17, 2006

(54) MECHANISM FOR GAS OPERATED GUN

(75) Inventors: Martin Carnall, Barwell (GB); Paul Garry, Manchester (GB)

(73) Assignee: Evolve Paintball Ltd., (GB)

( * ) Notice: Subject to any disclaimer, the term of this patent is extended or adjusted under 35 U.S.C. 154(b) by 55 days.

(21) Appl. No.: 10/775,756

(22) Filed: Feb. 9, 2004

(65) Prior Publication Data

US 2005/0115551 A1 Jun. 2, 2005

(51) Int. Cl.
*F41B 11/00* (2006.01)

(52) U.S. Cl. ..... 124/75; 124/71; 124/72; 124/73

(58) Field of Classification Search ..... 124/71–77
See application file for complete search history.

(56) References Cited

U.S. PATENT DOCUMENTS

| | | | | |
|---|---|---|---|---|
| 3,572,310 A | | 3/1971 | Chiba | 124/11 |
| 4,936,282 A | * | 6/1990 | Dobbins et al. | 124/74 |
| 5,349,938 A | | 9/1994 | Farrell | 124/73 |
| 5,613,483 A | | 3/1997 | Lukas et al. | |
| 5,769,066 A | | 6/1998 | Schneider | 124/75 |
| 6,810,871 B2 | * | 11/2004 | Jones | 124/77 |
| 2004/0089280 A1 | * | 5/2004 | Kunimoto | 124/76 |
| 2005/0028802 A1 | * | 2/2005 | Jones | 124/73 |

* cited by examiner

*Primary Examiner*—Michael J. Carone
*Assistant Examiner*—Troy Chambers
(74) *Attorney, Agent, or Firm*—Clifford Kraft

(57) ABSTRACT

A mechanism for a gas powered gun where a tubular bolt 10 of a paintball gun communicates with a cylinder 16 through bores 17 when in a forward, firing position, allowing compressed gas from the cylinder to expel a paintball. A port 20 whereby the cylinder communicates with a source of compressed gas is occluded by the bolt 10 except when a circumferential recess 23 in the bolt is in register with the port 20. By this arrangement only gas stored in the cylinder 16 is used to fire a paintball and the source of compressed gas is not in communication with the cylinder except when the trigger is released and the bolt 10 is withdrawn.

7 Claims, 1 Drawing Sheet

MECHANISM FOR GAS OPERATED GUN

This application is related to and claims priority from British application GB 0327683.9 filed Nov. 28, 2003.

FIELD OF THE INVENTION

This invention relates to an improved mechanism for a gas operated gun, by which is meant a gun of the type which fires a projectile by means of compressed gas. Guns of this kind are used in paintball games. Balls of paint are fired at other players to mark them.

DESCRIPTION OF THE PRIOR ART

Conventional paintball guns have a hollow bolt which, when the trigger is pulled to fire the gun, is moved from a rear to a forward position in the barrel, in the process selecting and moving forward the lowermost paintball in a magazine above the barrel. In the forward position of the bolt bores opening to its interior are exposed to compressed gas in a cylinder surrounding the bolt, causing the selected paintball to be expelled from the gun. When the trigger is released the bolt is moved back to its rear position, in which the bores are isolated from the cylinder.

A disadvantage of this otherwise simple arrangement is that more gas is used every time the gun is fired than is necessary to expel the selected paintball. Consequently the source of compressed gas, usually an air cylinder fitted to the gun housing, has to be replaced quite frequently, which is an expense and inconvenience.

U.S. Pat. No. 5,613,483 seeks to address this problem by attaching a spool valve to the rear of the bolt. A fill and a dump chamber are positioned in the gun housing behind the bolt. In the rear position of the bolt both chambers are filled with compressed gas, but when the bolt moves forward the spool valve isolates the chambers so that only the gas stored in the dump chamber escapes through the hollow bolt to fire the selected paint ball. A drawback of this gun is its complexity and relatively high manufacturing and maintenance costs.

SUMMARY OF THE INVENTION

A principal object of the present invention is to provide a simpler solution to the problem addressed by U.S. Pat. No. 5,613,483 allowing conventional paintball guns to have the advantages of the gun of that Patent as a result of a simple modification.

In accordance with the present invention there is provided a mechanism for a gas operated gun having a housing and a trigger, the mechanism comprising a hollow bolt slideably receiving a bolt guide fixed relative to the gun housing, the bolt being adapted to move to a forward position on the bolt guide when the trigger of the gun is pulled and to a rear position on the bolt guide when the trigger is released, the bolt having at least one radial bore at a position such that said bore is occluded by the bolt guide in the rear position of the bolt but not in the forward position of the bolt and a cylinder surrounding the bolt, the cylinder having a radial port communicating with a source of gas under pressure, characterised in that in the forward position of the bolt said port is occluded by the bolt to isolate the cylinder from said source such that only compressed gas stored in the cylinder is allowed to escape through said bore.

In a preferred embodiment of the invention the bolt has a circumferential recess dimensioned to communicate the interior of the cylinder with said source, the recess being in register with said port only when the bolt is in its rear position.

Said port is preferably located in a rearward position of the cylinder and communicates with said source via a passageway external to the cylinder and extending axially thereof.

Preferably means for displacing the bolt between its forward and rear positions surrounds the bolt guide behind said cylinder.

Said bore is preferably one of an array of radial bores circumferentially spaced around the bolt.

Said port may be a circumferential slot in a radial formation of the cylinder which extends into contact with the periphery of the bolt except when in register with said circumferential recess thereof.

The bolt guide may have axially spaced circumferential grooves in which respective O-ring seals are located, the positioning of the grooves being such that in the rear position of the bolt said bore or bores thereof is or are between said seals but in the forward position of the bolt said bore or bores is or are in advance of the foremost of said seals.

DESCRIPTION OF THE DRAWINGS

A preferred embodiment of the invention will now be described by way of non-limitative example with reference to the accompanying drawings, in which.

Figure 1:
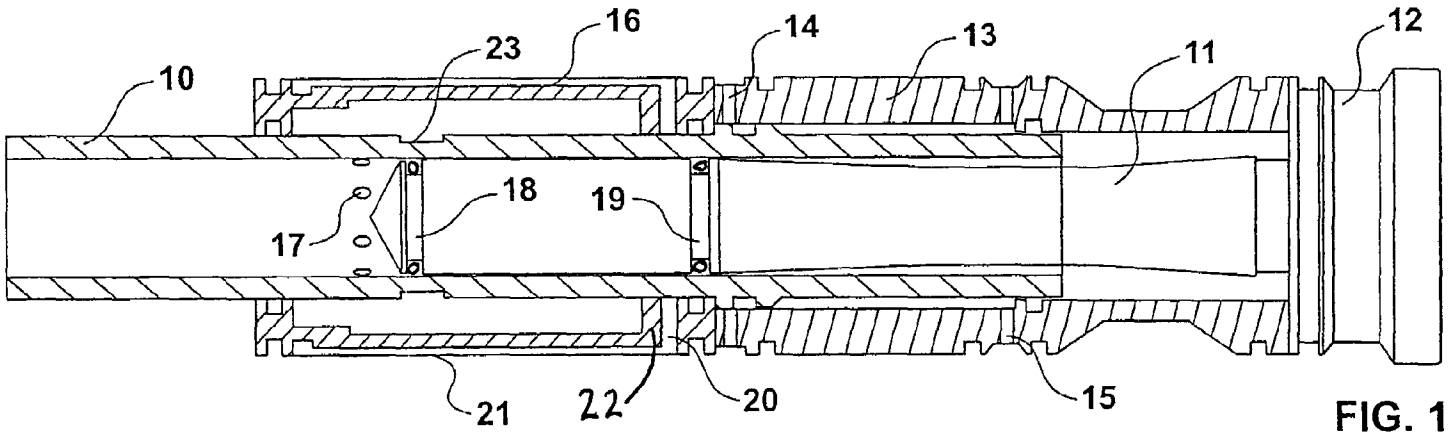
FIG. 1 illustrates part of the mechanism of a paintball gun showing the bolt in its forward or firing position.

Several figures are provided to aid in the understanding of the present invention. The scope of the present invention is not limited to these figures.

DETAILED DESCRIPTION OF THE INVENTION

A paintball gun has a hollow, tubular bolt 10 which is slideable on a bolt guide 11 fixed cantilever fashion to the rear of the gun housing (not shown) by its head 12. Surrounding the bolt and bolt guide is a mechanism 13 which serves to move the bolt 10 forward when the trigger (not shown) of the gun is pulled and rearward when the trigger is released. In the example illustrated this mechanism 13 works by placing a compressed gas canister (not shown) fitted to the gun selectively in communication with bores 14 and 15 whereby lands on the bolt will be driven in one direction or the other. This arrangement is conventional and so will not be further described, except to say that compressed gas actuation of the bolt may be replaced by an electronic system.

Figure 2:
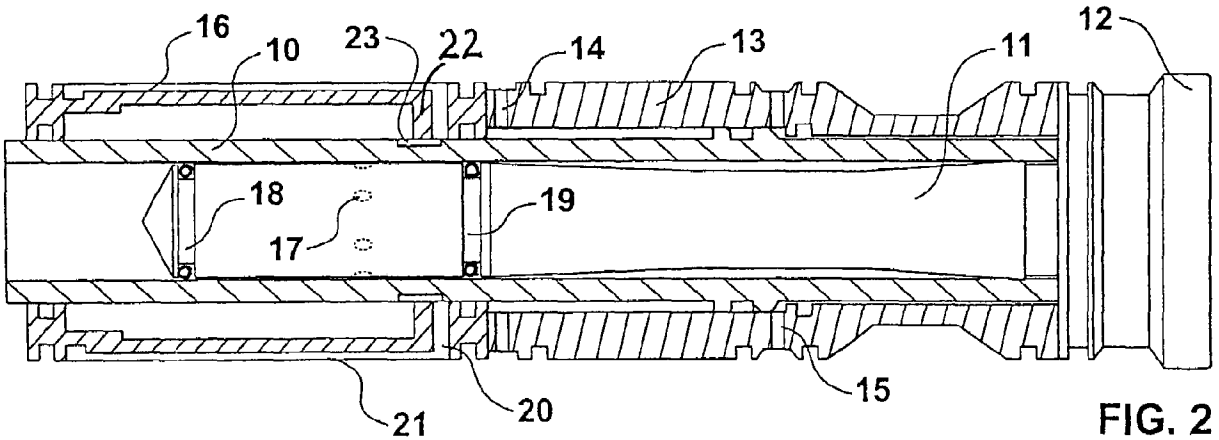
FIG. 2 illustrates the mechanism of FIG. 1 showing the bolt in its rear or withdrawn position.

Forward of the mechanism 13 a cylinder 16 surrounds the bolt and bolt guide. The cylinder extends beyond the distal end of the bolt guide 11 so that in the forward position of the bolt (FIG. 1) an array of circumferentially spaced radial bores 17 of the bolt exposes the interior of the bolt to the interior of the cylinder 16. In the withdrawn position of the bolt (FIG. 2) however the bores 17 are between O-ring seals 22 in axially spaced circumferential grooves 18 and 19 of the bolt guide 11 and therefore occluded from the cylinder 16.

A port 20 at the rear of the cylinder 16 is in communication with the canister via a passageway 21 external to the cylinder and extending axially thereof. In accordance with a preferred embodiment of the invention the port 20 takes the form of a circumferential slot in a radial formation 22 at the rear of the cylinder dimensioned such that it is in contact with the periphery of the bolt 10 except when it is in register with a circumferential recess 23 in the bolt periphery. This occurs when the bolt 10 is in its withdrawn position (FIG. 2) and the recess 23 has a length axially of the bolt such that it permits communication of the port 20 with the interior of the cylinder 16. Therefore so long as the trigger of the gun is not pulled the cylinder 16 is charged with compressed gas which cannot escape to the interior of the bolt. When the trigger is pulled and the bolt 10 moves forward (FIG. 1) the charge of compressed gas can escape from the cylinder 16 through the bores 17 to the interior of the bolt 10, but meanwhile the port 20 is occluded by the periphery of the bolt because the recess 23 has moved forward. As is known per se the bolt 10 as it moves forward displaces in to the barrel of the gun the lowermost paintball in a magazine (not shown) mounted above the gun and the selected paintball is fired from the gun by the compressed gas escaping from the cylinder 16. When the trigger is released and the bolt 10 is moved back the cylinder 16 is isolated from the interior of the bolt and is recharged with compressed gas as soon as the recess 23 comes back into register with the port 20.

In a conventional paintball gun the cylinder 16 is permanently in communication with the gas canister so that gas will escape through the bolt 10 for as long as the latter remains in its forward, firing position. Such a gun can be readily modified to ensure that when the gun is fired only compressed gas stored in the cylinder 16 will escape.

What is claimed is:

1. A mechanism for a gas operated gun having a housing and a trigger, the mechanism comprising a bolt guide fixed relative hollow bolt slideably receiving a to the gun housing, the bolt being adapted to move to a forward position on the bolt gun is pulled and to a rear position on the bolt guide when the trigger is released, the bolt having at least one radial bore at a position such that said bore is occluded guide when the trigger of the by the in the bolt guide in the rear position of the bolt but not forward position of the bolt and a cylinder surrounding the bolt, the cylinder having a radial port communicating with a source of gas under pressure, characterized in that in the forward position of the bolt said port is occluded by the bolt to isolate the cylinder from said source such that only compressed gas stored in the cylinder is allowed to escape through said bore.

2. A mechanism as claimed in claim 1, characterized in that the bolt has a circumferential recess dimensioned to communicate the interior of the cylinder with said source, the recess being in register with said port only when the bolt is in its rear position.

3. A mechanism as claimed in claim 1, characterized in that said port is located in a rearward position of the cylinder and communicates with said source via a passageway external to the cylinder and extending axially thereof.

4. A mechanism as claimed in claim 1, characterized in that means for displacing the bolt between its forward and rear positions surrounds the bolt guide behind said cylinder.

5. A mechanism as claimed in claim 1, characterized in that said bore is one of an array of radial bores circumferentially spaced around the bolt.

6. A mechanism as claimed in claim 1, characterized in that said port is a circumferential slot in a radial formation of the cylinder which extends into contact with the periphery of the bolt except when in register with said circumferential recess thereof.

7. A mechanism as claimed in claim 1, characterized in that the bolt guide has axially spaced circumferential grooves in which respective O-ring seals are located, the positioning of the grooves being such that in the rear position of the bolt said bore or bores thereof is or are between said seals but in the forward position of the bolt said bore or bores is or are in advance of the foremost of said seals.

* * * * *

UNITED STATES PATENT AND TRADEMARK OFFICE

CERTIFICATE OF CORRECTION

PATENT NO. : 6,986,343 B2
APPLICATION NO. : 10/775756
DATED : January 17, 2006
INVENTOR(S) : Martin Carnall and Paul Gary It is certified that error appears in the above-identified patent and that said Letters Patent is hereby corrected as shown below:

Please make the following amendment to Claim 1:

Line 2, insert -- hollow bolt slideably receving a -- between the words "a" and "bolt";

Line 3, delete "hollow bolt slideably receving a";

Line 5, insert -- guide when the trigger of the -- between "bolt" and "gun";

Lines 7 and 8, delete "guide when the trigger of the";

Line 8, delete "in the " (first occurrence);

Line 9, insert -- in the -- after "not".

As amended, Claim 1 (currently amended) reads as follows: A mechanism for a gas operated gun having a housing and a trigger, a mechanism comprising a hollow bolt slideably receiving a bolt guide fixed relative ~~hollow bolt slideably~~ receiving a to the gun housing, the bolt being adapted to move to a forward position on the bolt guide when the trigger of the gun is pulled and to a rear position on the bolt guide when the trigger is released, the bolt having at least one radial bore at a position such that said bore is occluded ~~guide when the trigger of the~~ by the ~~in the~~ bolt guide in the rear position of the bolt but not in the forward position of the bolt and a cylinder surrounding the bolt, the cylinder having a radial port communicating with a source of gas under pressure,

UNITED STATES PATENT AND TRADEMARK OFFICE

CERTIFICATE OF CORRECTION

PATENT NO. : 6,986,343 B2
APPLICATION NO. : 10/775756
DATED : January 17, 2006
INVENTOR(S) : Martin Carnall and Paul Gary It is certified that error appears in the above-identified patent and that said Letters Patent is hereby corrected as shown below:

As amended, Claim 1 (cont'd):
characterized in that in the forward position of the bolt said port is occluded by the bolt to isolate the cylinder from said source such that only compressed gas stored in the cylinder is allowed to escape through said bore.

Signed and Sealed this

Sixth Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 6,986,343 B2 
APPLICATION NO. : 10/775756
DATED : January 17, 2006
INVENTOR(S) : Martin Carnall and Paul Gary It is certified that error appears in the above-identified patent and that said Letters Patent is hereby corrected as shown below:

Please make the following amendment to Claim 1:

Line 2, insert -- hollow bolt slideably receving a -- between the words "a" and "bolt";

Line 3, delete "hollow bolt slideably receving a";

Line 5, insert -- guide when the trigger of the -- between "bolt" and "gun";

Lines 7 and 8, delete "guide when the trigger of the";

Line 8, delete "in the " (first occurrence);

Line 9, insert -- in the -- after "not".

As amended, Claim 1 (currently amended) reads as follows: A mechanism for a gas operated gun having a housing and a trigger, a mechanism comprising a hollow bolt slideably receiving a bolt guide fixed relative ~~hollow bolt slideably~~ to the gun housing, the bolt being adapted to move to a forward position on the bolt guide when the trigger of the gun is pulled and to a rear position on the bolt guide when the trigger is released, the bolt having at least one radial bore at a position such that said bore is occluded ~~guide when the trigger of the~~ by the ~~in the~~ bolt guide in the rear position of the bolt but not in the forward position of the bolt and a cylinder surrounding the bolt, the cylinder having a radial port communicating with a source of gas under pressure,

UNITED STATES PATENT AND TRADEMARK OFFICE

CERTIFICATE OF CORRECTION

PATENT NO. : 6,986,343 B2
APPLICATION NO. : 10/775756
DATED : January 17, 2006
INVENTOR(S) : Martin Carnall and Paul Gary It is certified that error appears in the above-identified patent and that said Letters Patent is hereby corrected as shown below:

As amended, Claim 1 (cont'd):
characterized in that in the forward position of the bolt said port is occluded by the bolt to isolate the cylinder from said source such that only compressed gas stored in the cylinder is allowed to escape through said bore.

This certificate supersedes the Certificate of Correction issued November 6, 2007.

Signed and Sealed this

Twenty-fifth Day of March, 2008

JON W. DUDAS
*Director of the United States Patent and Trademark Office*